US006235108B1

(12) United States Patent
Lambrechts

(10) Patent No.: US 6,235,108 B1
(45) Date of Patent: May 22, 2001

(54) STEEL FIBER FOR REINFORCEMENT OF HIGH-PERFORMANCE CONCRETE

(75) Inventor: Ann Lambrechts, Herentals (BE)

(73) Assignee: N.V. Bekaert S.A., Zwevegem (BE)

( * ) Notice: Subject to any disclaimer, the term of this patent is extended or adjusted under 35 U.S.C. 154(b) by 0 days.

(21) Appl. No.: 09/355,975

(22) PCT Filed: Feb. 23, 1998

(86) PCT No.: PCT/EP98/01126

§ 371 Date: Aug. 23, 1999

§ 102(e) Date: Aug. 23, 1999

(87) PCT Pub. No.: WO98/38398

PCT Pub. Date: Sep. 3, 1998

(30) Foreign Application Priority Data

Feb. 28, 1997 (EP) ..... 97200582

(51) Int. Cl.[7] ..... E04C 5/01; C04B 14/48

(52) U.S. Cl. ..... 106/644; 106/643; 428/399; 428/400; 428/603

(58) Field of Search ..... 106/644, 643; 428/399, 400, 603

(56) References Cited

U.S. PATENT DOCUMENTS

| | | | | |
|---|---|---|---|---|
| 4,224,377 | | 9/1980 | Moens | 428/369 |
| 5,215,830 | * | 6/1993 | Cinti | 428/606 |
| 5,503,670 | * | 4/1996 | Richard et al. | 106/643 |
| 5,865,000 | * | 2/1999 | Nemegeer et al. | 52/309.1 |

FOREIGN PATENT DOCUMENTS

| | | | |
|---|---|---|---|
| 1005815 | | 2/1994 | (BE) . |
| 1941223 | | 2/1971 | (DE) . |
| 2832495 | | 2/1980 | (DE) . |
| 3024648 | | 1/1982 | (DE) . |
| 3032162 | | 4/1982 | (DE) . |
| 3347675 | | 10/1985 | (DE) . |
| 8815120 | | 3/1989 | (DE) . |
| 4223804 | | 1/1994 | (DE) . |
| 2026464 | | 2/1980 | (GB) . |
| 93/23343 | * | 11/1993 | (WO) . |
| 9501316 | | 1/1995 | (WO) . |
| 98/38398 | * | 9/1998 | (WO) . |

* cited by examiner

*Primary Examiner*—Anthony Green
(74) *Attorney, Agent, or Firm*—Foley & Lardner

(57) ABSTRACT

A steel fiber (10) for reinforcement of high-performance concrete or mortar has a length ranging from 3 mm to 30 mm, a thickness ranging from 0.08 mm to 0.30 mm, and a tensile strength greater than 2000 MPa. The steel fiber is provided with anchorages (12,24) the dimension of which in a direction perpendicular to the longitudinal axis of the steel fiber is maximum 50% of the thickness. These anchorages provide an effective staying in the high-performance concrete without influencing the mixability of the steel fibers in a negative way.

12 Claims, 2 Drawing Sheets

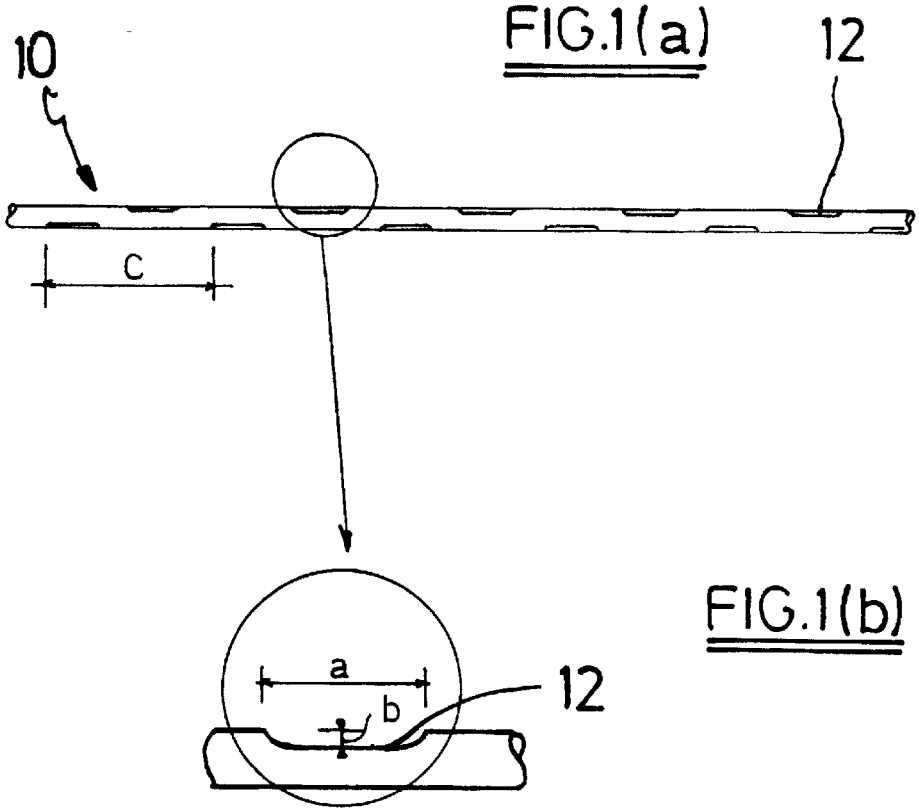
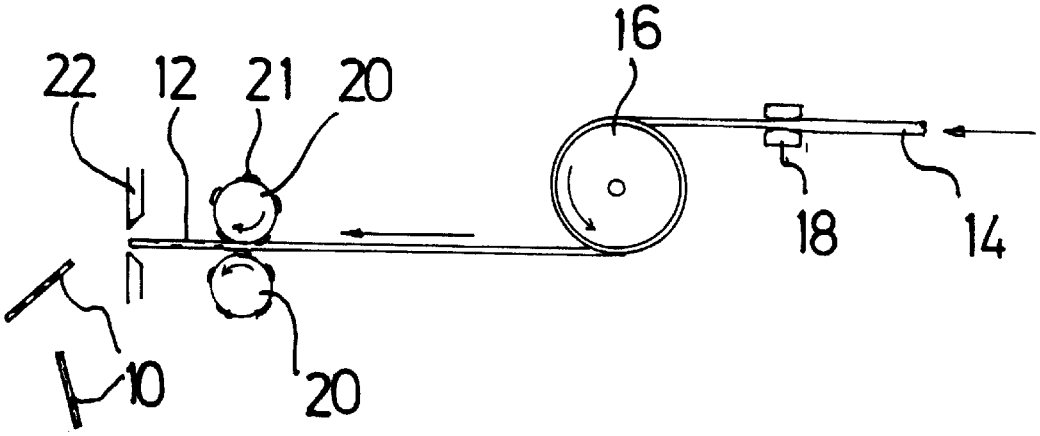
FIG. 2

STEEL FIBER FOR REINFORCEMENT OF HIGH-PERFORMANCE CONCRETE

FIELD OF THE INVENTION

The invention relates to a straight steel fiber for reinforcement of high-performance concrete or mortar.

BACKGROUND OF THE INVENTION.

It is known in the art to reinforce high-performance concretes by means of steel fibers.

BE-A3-1005815 (N.V. BEKAERT S.A.) teaches that for conventional concretes with a compressive strength ranging from 30 MPa to 50 MPa, it makes no sense to increase the tensile strength of a steel fiber above 1300 MPa since an increase in tensile strength does not add any increase in flexural strength to the reinforced concrete. BE 1005815 further teaches, however, that for concretes with an increased compressive strength, the tensile strength of the steel fibers should increase proportionally.

WO-A1-95/01316 (BOUYGUES) adapts the average length of metal fibers to the maximum size of granular elements which are present in high-performance concrete so that metal fibers act as conventional rebars in high-performance concrete. The volume percentage of metal fibers in high-performance concrete is relatively high and ranges DE-A1-33 47 675 (LAMPRECHT Gerd) relates to an artificial stone of cement or gypsum reinforced by means of thin fibers made of a high-alloyed steel. The high-alloyed steel fibers are provided with roughnesses on their surface in order to increase the adhesion in the cement and the gypsum. The fibers have a diameter ranging from 0.05 mm to 0.15 mm and the depth of the roughnesses is limited to 30% of the diameter of the fibers.

SUMMARY OF THE INVENTION

It is an object of the present invention to further optimize the geometry and the tensile strength of steel fibers to high-performance concrete.

It is also an object of the present invention to reduce mixing problems when reinforcing high-performance concrete with high volume percentages of steel fibers.

It is another object of the present invention to improve the anchorage of steel fibers in the reinforcement of high-performance concrete.

According to one aspect of the present invention, there is provided a straight steel fiber for reinforcement of high-performance concrete or mortar. The steel fiber has a length ranging from 3 mm to 30 mm, a thickness ranging from 0.08 mm to 0.30 mm and a tensile strength greater than 2000 MPa, e.g. greater than 2500 MPa, or greater than 3000 MPa. The steel fiber is provided with anchorages the dimension of which in a direction perpendicular to the longitudinal axis of the steel fiber is maximum 50%, e.g. maximum 25%, e.g. maximum 15%, of the thickness.

The terms 'high-performance concrete or mortar' refer to concrete or mortar the compression strength of which is higher than 75 MPa (1 MPa=1 Mega-Pascal=1 Newton/mm$^2$), e.g. higher than 200 MPa. The compression strength is the strength as measured by ASTM-Standard N° C39-80 on a cube of concrete of 150 mm edge, where the cube is pressed between two parallel surfaces until rupture.

The term 'thickness' of a steel fiber refers to the smallest cross-sectional dimension of a straight steel fiber without the anchorages.

The term 'anchorage' refers to any deviation from a straight steel fiber with a uniform transversal cross-section where the deviation helps to improve the anchorage or staying of the steel fiber in the concrete.

Within the context of the present invention, the terms 'straight steel fiber' excludes normal bendings but does not exclude small bendings, i.e. bendings with a high radius of curvature, in the steel fiber which are a result of the steel wire having been wound on a spool before the final drawing and/or cutting. Steel fibers with only such small bendings which are the result of the previous winding of the steel wire, are still considered as 'straight steel fibers'.

The advantage of the present invention may be explained as follows. Concretes have a so-called interfacial zone between the cement paste and aggregates added to the concrete. This interfacial zone can be studied by means of a scanning electronic microscope (SEM). It has been observed that due to an increased presence of water in the neighbourhood of the aggregates, cement hydration is accelerated in the interfacial zone, resulting in the presence of calcium hydroxide intermixed with calcium-silica-hydrates and ettringite in the interfacial zone. The consequence is an interfacial zone with a relatively high degree of porosity. This interfacial zone forms the weakest link of the concrete and determines to a large extent its strength which tends to be smaller than the strength of its cement paste. The thickness of the interfacial zone ranges from about 50 $\mu$m (micrometer) to about 100 $\mu$m around the aggregates. A similar interfacial zone has been observed around steel fibers added to the concrete.

In comparison with conventional concretes, high-performance concretes are characterized by:

(a) a relatively low water/cement ratio (smaller than 0.45);

(b) the addition of superplasticizers which much increase the workability of concrete in spite of the low water/cement ratio;

(c) the addition of mineral additives such as silica fumes, fly ashes, blast furnace slag, pulverized fuel, micro-fillers and/or pozzolans and/or the addition of chemical additives such as water glass and tensides.

The additives mentioned under (c) result in an increased bond between aggregates and cement and result in an interfacial zone the thickness of which is substantially decreased, if not disappeared. Indeed silica fumes, for example, transform the calcium hydroxides of the interfacial zone into calcium-silica-hydrates.

In order to have an effective anchorage or staying in conventional concretes, steel fibers must have anchorages with dimensions that are a few times the thickness of the interfacial zone, i.e. a few times 50 $\mu$m–100 $\mu$m. Anchorages with smaller dimensions will not work to the same degree, since they would not bridge adequately the interfacial zone. In contradiction with the interfacial zone of conventional concrete, the interfacial zone of high-performance concretes is either not so weak or not so thick or even not existent. The result is that steel fibers provided with anchorages of a small dimension work effectively.

A supplementary advantage of the smaller dimensions of the anchorage is that the mixing problem of steel fibers in the concrete is reduced since there are no substantial bendings any more.

Another advantage is that, due to the improved anchorage, the volume of steel fibers needed for a required performance of the concrete, may be reduced, which also reduces considerably the degree of mixing problems. This is very important since the volume percentage of steel fibers in high-performance concrete is substantially higher (normally 1.0% to 4.0%) than in conventional concretes (normally 0.40% to 1.0%), and the higher this volume percentage the greater the risk for mixing problems.

Within the context of the present invention the anchorages are not limited to a particular form or way of manufacturing. The anchorages may take the form of bendings or waves on condition that their dimension in a direction perpendicular to the longitudinal axis of the steel fiber is limited in size. The anchorages may also take the form of micro-roughenings, e.g. obtained by means of a controlled oxidation or by means of a controlled etching operation.

In a first preferable embodiment of the invention the anchorages are indentations which are distributed along the length of a straight steel fiber. The depth of these indentations ranges from 5% to 25% of the thickness of the steel fiber without indentations. For example, the depth of these indentations ranges from 0.01 mm to 0.05 mm. The indentations may be provided at regular distances along the length of the steel fiber.

In a second preferable embodiment of the invention the steel fiber is provided with flattenings at both ends of the steel fiber. The thickness of the flattened ends may range from 50% to 85% of the thickness of the non-flattened steel fiber. Such a steel fiber has preferably an elongation at fracture which is greater than 4%.

In order to provide the required tensile strength, a steel fiber according to the present invention preferably has a carbon content above 0.40%, e.g. above 0.82%, or above 0.96%.

According to a second aspect of the present invention, there is provided a method for improving the mixability of steel fibers in high-performance concrete, said concrete having a compressive strength greater than 75 MPa, said method comprising the steps of:

(a) providing straight steel fibers; said steel fibers having a length ranging from 3 mm to 30 mm, a thickness ranging from 0.08 mm to 0.30 mm, (b) providing anchorages in said steel fibers, said anchorages having a dimension in a direction perpendicular to the longitudinal axis of the steel fibers of maximum 50% of the thickness of the steel fibers.

Or viewed from another angle, there is provided a method of adapting the anchorages of a steel fiber to the dimensions of an interfacial in a high-performance concrete or mortar. The method comprises the following steps:

(a) providing a steel fiber with a length ranging from 3 mm to 30 mm, a thickness ranging from 0.08 mm to 0.30 mm, a tensile strength greater than 2000 MPa, (b) providing said steel fiber with anchorages the dimension of which in a direction perpendicular to the longitudinal axis of the steel fiber is maximum 50% of the thickness.

BRIEF DESCRIPTION OF THE DRAWINGS

The invention will now be described into more detail with reference to the accompanying drawings wherein FIG. 1(*a*) gives a global view of a steel fiber provided with indentations along its length;

FIG. 1(*b*) gives an enlarged view of an indentation;

FIG. 2 schematically illustrates how a steel fiber with indentations can be manufactured;

DESCRIPTION OF THE PREFERRED EMBODIMENTS OF THE INVENTION

First Preferable Embodiment

Figure 3A:
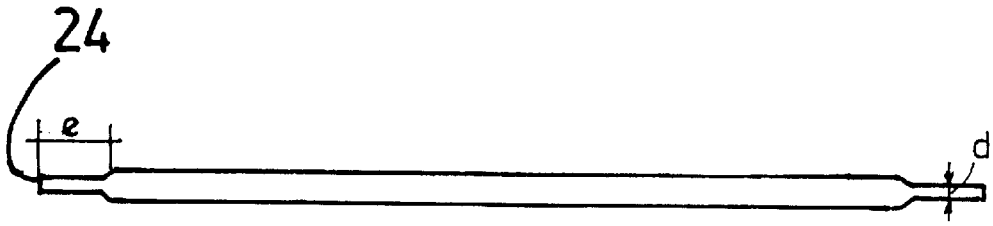
FIG. 3(*a*) gives a side view and FIG. 3(*b*) gives an upper view of a steel fiber with flattened ends.

FIG. 1(*a*) shows a steel fiber 10 which is provided with indentations 12 which are regularly distributed along its length. FIG. 1(*b*) illustrates in more detail an indentation 12. For example, the steel fiber 10 has a length of 13 mm, and—apart from the indentations 12—a round cross-section with a diameter of 0.20 mm. The size a of an indentation 12 in the longitudinal direction is 0.50 mm and the depth b of an indentation 12 is 0.010 mm (=10 $\mu$m). The indentations 12 are provided both at the upper side and at the under side of the steel fiber 10. The distance (pitch) between two indentations at the upper or at the under side is about 1.50 mm.

FIG. 2 illustrates how a steel fiber 10 with indentations 12 can be manufactured. A steel wire 14 is drawn by means of a winding drum 16 through a (final) reduction die 18. Having reached its final diameter the wire 14 is further guided to two wheels 20 which are both provided at their surface with protrusions 21 in order to form the indentations 12 in the wire 14. The two wheels 20 give the necessary pulling force to guide the wire 14 from the winding drum 16 to a cutting tool 22 where the steel wire 14 is cut into steel fibers 10 of the same lengths.

Second Preferable Embodiment

Figure 3B:
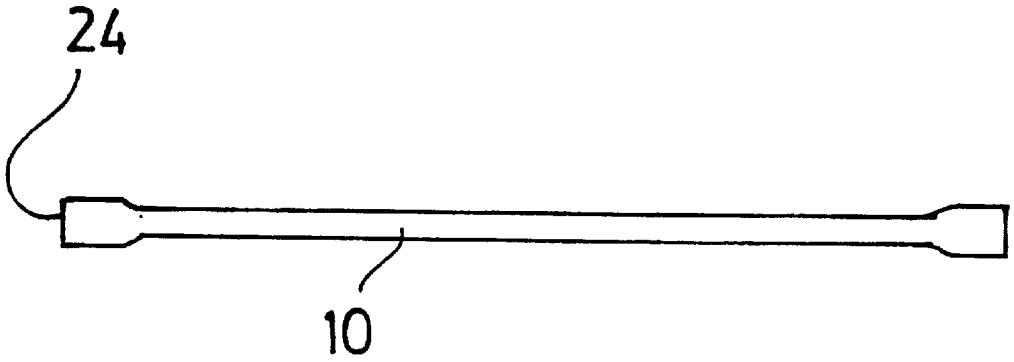

FIGS. 3(*a*) and 3(*b*) illustrate a straight steel fiber 10 with flattened ends 24. The flattened ends 24 provide the anchorage in the high-performance concrete. Preferably the steel fiber 10 has no burrs since burrs could provoke concentrations of tensions in the concrete and these concentrations could lead to initiation of cracks. The transition in the steel fiber 10 from the round transversal cross-section to the flattened ends 24 should not be abrupt but should be gradually and smooth. As an example the steel fiber 10 has following dimensions: a length of 13 mm, a diameter of a round cross-section of 0.20 mm, a thickness d of the flattened ends 24 of 0.15 mm and a length e of the flattened ends 24—transition zone included—of 1.0 mm.

Figure 4:
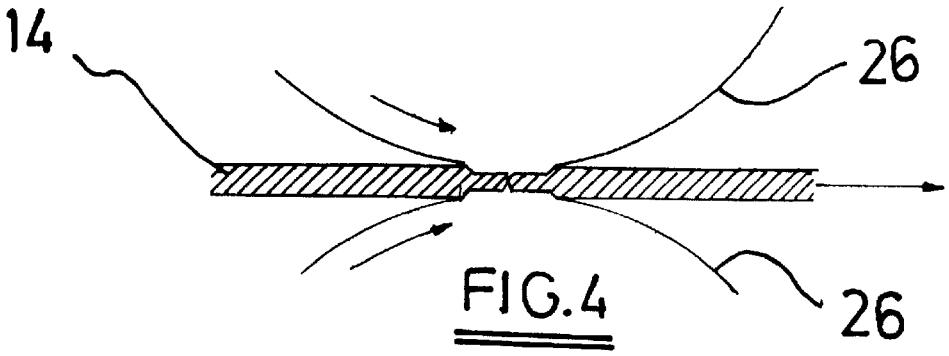
FIG. 4 schematically illustrates how a steel fiber with flattened ends can be manufactured.

FIG. 4 illustrates how a steel fiber 10 with flattened ends 24 can be manufactured by means of two rolls 26 which give flattenings to a steel wire 14 and simultaneously cut the steel wire into separate steel fibers.

Since a steel fiber 10 according to this second embodiment will be anchored in the high-performance concrete only at the ends 24 (and not along its length as in the first embodiment), it is preferable to increase the potential of plastic energy in the steel fiber by applying a suitable thermal treatment in order to increase the elongation at fracture of the steel fiber 10. Such a thermal treatment is known as such in the art. The thermal treatment can be applied by passing the steel wire 14 through a high-frequency or mid-frequency induction coil of a length that is adapted to the speed of the steel wire and to heat the steel wire 14 to about more than 400° C. The steel wire will suffer from a certain decrease of its tensile strength (about 10 to 15%) but at the same time will see its elongation at fracture increase. In this way the plastic elongation can be increased to more than 5% and even to 6%.

The composition of the steel fiber may vary to a large extent. Conventionally it comprises a minimum carbon content of 0.40% (e.g. at least 0.80%, e.g. 0.96%), a manganese content ranging from 0.20 to 0.90% and a silicon content ranging from 0.10 to 0.90%. The sulphur and phosphorous contents are each preferably kept below 0.03%. Additional elements such as chromium (up to 0.2 à 0.4%), boron, cobalt, nickel, vanadium . . . may be added to the composition in order to reduce the degree of reduction required for obtaining a particular tensile strength.

The steel fiber can be provided with a coating such as a metallic coating. For example it can be provided with a copper alloy coating in order to increase its drawability or it can be provided with a zinc or aluminum alloy coating in order to increase its corrosion resistance.

The steel fiber according to the present invention is not limited to particular tensile strengths of the steel fiber. For steel fibers of 0.20 mm thickness tensile strengths can be obtained ranging from moderate values of 2000 MPa to higher values of 3500 MPa, 4000 MPa and even higher. It is preferable, however, to adapt the tensile strength of the steel fiber both to the compression strength of the high-performance concrete and to the quality of the anchorage in the high-performance concrete. The higher the degree of anchorage in the concrete, the more useful it is to further increase the tensile strength of the steel fiber itself.

The steel fibers according to the invention may be glued together by means of a suitable binder which looses its binding ability when mixing with the other components of the high-performance concrete. The applying of such a binder increases the mixability, as has been explained in U.S. Pat. No. 4,224,377. However, in the context of the present invention, this is not strictly necessary.

What is claimed is:

1. A concrete or mortar having a compressive strength greater than 75 MPa, comprising:

aggregates;

cement paste;

an interfacial zone between said cement paste and said aggregates; and steel fibers said steel fibers comprising a length ranging from 3 mm to 30 mm, a thickness ranging from 0.08 mm to 0.30 mm, and anchorages comprising a dimension in a direction perpendicular to said length of said steel fibers that is a minimum of 0.01 mm and a maximum of 50% of said thickness configured so as to bridge said interfacial zone.

2. A concrete or mortar according to claim 1 wherein said dimension of said anchorages in a direction perpendicular to said length of said steel fibers is a maximum of 25% of said thickness.

3. A concrete or mortar according to claim 1 wherein said dimension of said anchorages in a direction perpendicular to said length of said steel fibers is a maximum of 15% of said thickness.

4. A concrete or mortar according to claim 1 wherein said anchorages are indentations distributed along the length of said steel fibers.

5. A concrete or mortar according to claim 4 wherein said indentations have a depth dimension in a direction perpendicular to said length of said steel fibers that ranges from 0.01 mm to 0.05 mm.

6. A concrete or mortar according to claim 1 wherein said anchorages are flattenings at both ends of said steel fibers.

7. A concrete or mortar according to claim 6 wherein said steel fibers have a total elongation at fracture greater than 4%.

8. A concrete or mortar according to claim 1 wherein said steel fibers have a carbon content greater than 0.40%.

9. A concrete or mortar according to claim 8 wherein said steel fibers have a manganese content ranging from 0.10% to 0.90% and a silicon content ranging from 0.10% to 0.90%.

10. A method for improving the mixability of steel fibers in high-performance concrete with a compressive strength greater than 75 MPa, comprising the steps of:

providing a concrete or mortar comprising cement paste and aggregates, and an interfacial zone between said cement paste and said aggregates;

providing straight steel fibers comprising a length ranging from 3 mm to 30 mm, a thickness ranging from 0.08 mm to 0.30 mm, and anchorages, said anchorages comprising a dimension in a direction perpendicular to said length of said steel fibers of a minimum of 0.01 mm and a maximum of 50% of said thickness of said steel fibers so as to bridge said interfacial zone; and mixing said steel fibers in said concrete or mortar.

11. A method according to claim 10, wherein said steel fibers have a tensile strength of at least 2000 MPa.

12. A method of adapting the anchorages of steel fibers to a zone thickness dimension of an interfacial zone in a high-performance concrete or mortar, said method comprising the steps of:

providing steel fibers comprising a length ranging from 3 mm to 30 mm, a thickness ranging from 0.08 mm to 0.30 mm, and a tensile strength greater than 2000 MPa; and forming anchorages in said steel fibers with a dimension in a direction perpendicular to said length of said steel fiber of a minimum of 0.01 mm and a maximum of 50% of said thickness, so that said dimension in a direction perpendicular to said length exceeds the zone thickness dimension of the interfacial zone.

* * * * *